US005850839A

United States Patent [19]

Adami

[11] Patent Number: 5,850,839

[45] Date of Patent: Dec. 22, 1998

[54] CIGAR AROMATIZING DEVICE

[76] Inventor: Larry W. Adami, 2385 Fiesta Dr., Sarasota, Fla. 34231

[21] Appl. No.: 851,747

[22] Filed: May 6, 1997

[51] Int. Cl.[6] ..... A24B 15/00; A24B 15/30; A24F 11/00; A24F 47/00

[52] U.S. Cl. ..... 131/274; 131/275; 131/328; 131/329; 206/242; 206/204; 312/31

[58] Field of Search ..... 312/31, 31.01, 312/31.02, 31.03, 31.04, 31.05, 31.06, 31.1, 31.2, 31.3; 131/328, 329, 300, 275, 274; 206/213.1, 256, 242, 248, 204, 205

[56] References Cited

U.S. PATENT DOCUMENTS

| | | | |
|---|---|---|---|
| 219,819 | 9/1879 | Knowlton | 312/31 |
| 273,205 | 2/1883 | Wentzell | 312/31 |
| 441,557 | 11/1890 | Heydt . | |
| 783,541 | 2/1905 | Raisler . | |
| 1,026,154 | 5/1912 | Doughty | 312/31.2 |
| 1,129,921 | 3/1915 | Tourtellot | 312/31 |
| 1,220,376 | 3/1917 | Tearney et al. | 312/31 |
| 1,668,892 | 5/1928 | Durham . | |
| 1,712,024 | 5/1929 | Brogden . | |
| 1,965,129 | 7/1934 | Patterson | 131/30 |
| 2,058,800 | 4/1936 | Jasper | 131/30 |
| 2,074,122 | 3/1937 | Harris | 131/30 |
| 2,534,829 | 12/1950 | Otallah | 312/31 |
| 3,382,020 | 5/1968 | Meri . | |
| 5,607,051 | 3/1997 | Esponosa . | |

*Primary Examiner*—Stanley S. Silverman
*Assistant Examiner*—Jacqueline A. Ruller
*Attorney, Agent, or Firm*—Charles J. Prescott

[57] ABSTRACT

A cigar aromatizing device for flavoring cigars with aromatic vapors produced e.g. from an alcohol based liquor. The device includes an enclosure into which the liquid holding tray and a cigar rack are positionable. Individual cigars held in spaced apart, preferably upright position within the rack are exposed to the aromatic vapors as a quantity of aromatic or flavored liquid in the tray evaporates or vaporizes. With a lid in place to substantially seal or close the enclosure, vapors may be absorbed into each cigar for an extended period.

5 Claims, 2 Drawing Sheets

CIGAR AROMATIZING DEVICE

BACKGROUND OF THE INVENTION

1. Field of Invention

This invention relates generally to cigar humidors, and more particularly to a cigar aromatizing device which utilizes a flavored liquid for enhanced cigar smoking enjoyment.

2. Prior Art

Cigar humidors and the general notion of adding moisture to cigars to avoid their becoming excessively dry prior to smoking are well known. An early humidor for cigars is disclosed in U.S. Pat. No. 441,557 wherein Heydt disclosed a separate moisture partition containing a sponge disposed at one end of a cigar containing box, the partition having apertures for allowing moisture in the sponge to seep or evaporate therethrough.

Raisler, in U.S. Pat. No. 783,541 generally teaches a box for tobacco and the like having an absorbent pad disposed within the lid, the inner panel of the lid having small apertures or perforations for allowing moisture contained within the absorbent pad to seep or evaporate therethrough into the main portion of the tobacco-containing box. A separate wet pad is disposed between spaced panels of the lower portion of the box which will also release quantities of moisture through apertures in that portion of the box as well.

A cigar humidifier is also disclosed in U.S. Pat. No. 1,668,892 invented by Durham having a moistenable sponge disposed within an elongated compartment adjacent to and outside of the interior edge of the lid of the box.

A cabinet formed entirely of sheet metal and invented by Brogden is disclosed in U.S. Pat. No. 1,712,024. Brogden, in this patent, teaches a plurality of metal pans having perforated lids positionable within the cabinet for holding a quantity of water which, as the water evaporates, humidifies the entire interior of the cabinet and its tobacco related contents.

In U.S. Pat. No. 3,382,020, Meri, teaches a humidor or tobacco box with a sponge disposed in the lower portion thereof for dispensing vaporized water through apertures in a bottom panel. Meri also teaches utilization of an electrical circuit which activates a light to advise the user when the sponge has run dry.

Lastly, Espinosa teaches a cigar humidor in U.S. Pat. No. 5,607,051 which includes first and second cigar storage compartments. The first compartment includes a humidifier for long-term cigar storage and a larger second compartment isolated from all sources of humidity within the humidor into which cigars from the first humid compartment are transferred which are intended for smoking in the near-term future.

The present invention discloses a device which will aromatize cigars contained therein with vapors from a flavored or aromatic liquid such as a liqueur. Typically, the liquid utilized for vapor aromatizing the cigars will be selected from those which are alcohol based and contain a liqueur flavoring of the user's choice.

BRIEF SUMMARY OF THE INVENTION

This invention is directed to a cigar aromatizing device for flavoring cigars with aromatic vapors produced e.g. from an alcohol based liqueur. The device includes an enclosure into which the liquid holding tray and a cigar rack are positionable. Individual cigars held in spaced apart, preferably upright position within the rack are exposed to the aromatic vapors as a quantity of aromatic or flavored liquid in the tray evaporates or vaporizes. With a lid in place to substantially seal or close the enclosure, vapors may be absorbed into each cigar for an extended period.

It is therefore an object of this invention to provide a cigar aromatizing device which will flavor cigars with emanating vapors from a preselected aromatic liquid such as a flavored liqueur.

It is another object of this invention to provide a transparent cigar aromatizing device so that the cigars contained therein may be viewed as to their number and status of being aromatically flavored within the device without the need for opening or removing the lid.

It is still another object of this invention to provide a cigar aromatizing device which may be easily disassembled and cleaned before replenishing the supply of aromatic liquid for flavoring cigars which are preferably held in spaced apart upright orientation within the device.

In accordance with these and other objects which will become apparent hereinafter, the instant invention will now be described with reference to the accompanying drawings.

DETAILED DESCRIPTION OF THE INVENTION

Figure 1:
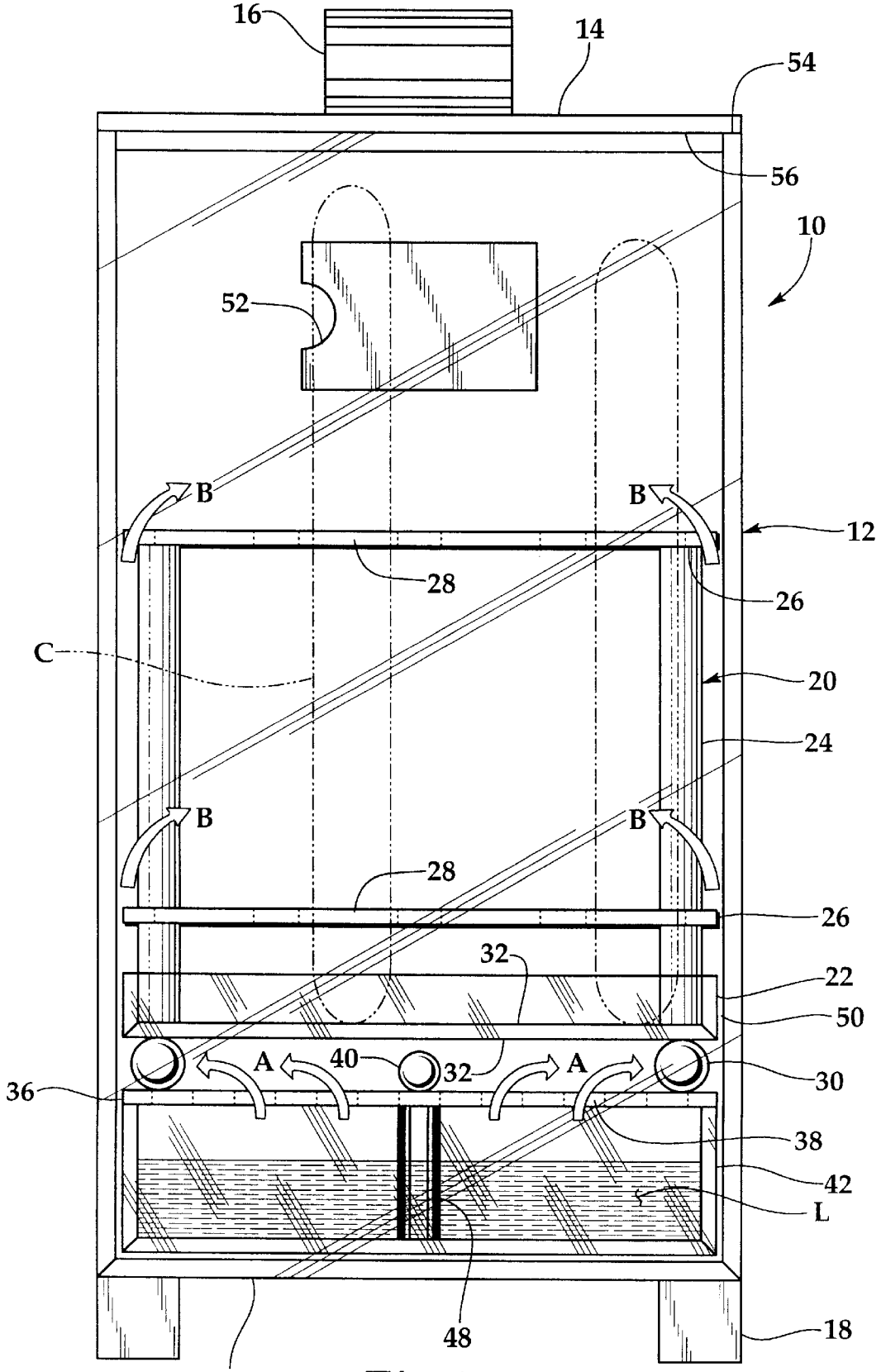
FIG. 1 is a side elevation view of a transparent preferred embodiment (10) of the invention.
Figure 2:
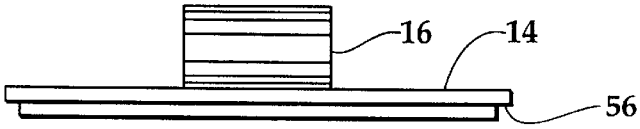
FIG. 2 is a side elevation view of a removable lid (14) of FIG. 1.

Referring now to the drawings, the invention is shown generally at numeral 10 as best seen in FIG. 1 and includes a transparent rectangular enclosure 12 formed of transparent acrylic plastic stock material having rectangular upright side walls which are open at an upper margin 54 thereof to define an open end of the enclosure 12. A bottom panel 58 of the enclosure 12 is sealed or otherwise rigidly connected to all upright side panels. A transparent removable lid 14 having a handle 16 which substantially mates along a sealing surface 56 with the upper margin 54 is also provided.

Figure 3:
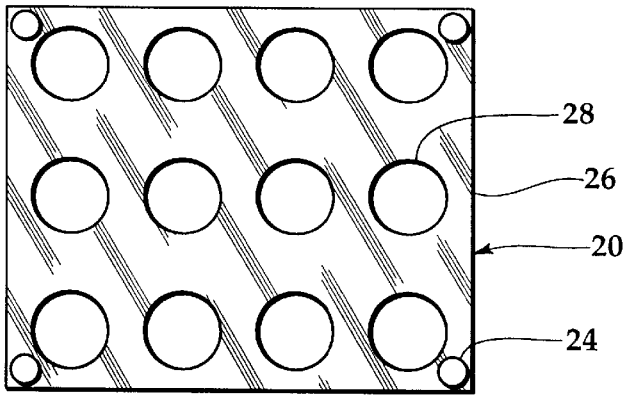
FIG. 3 is a top plan view of the rack (20) of FIG. 1.
Figure 4:
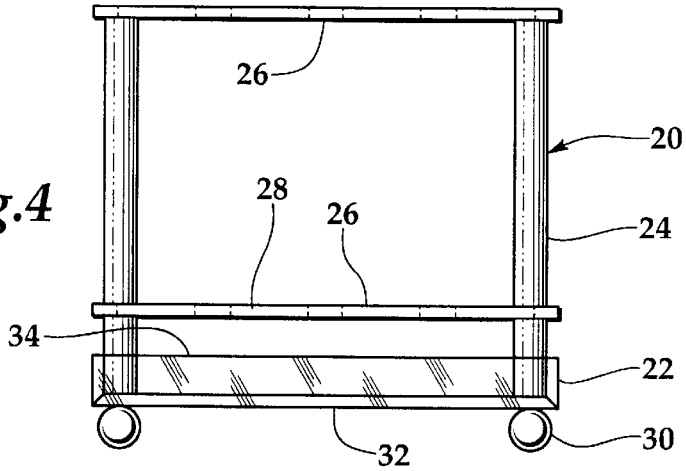
FIG. 4 is a side elevation view of FIG. 3.
Figure 5:
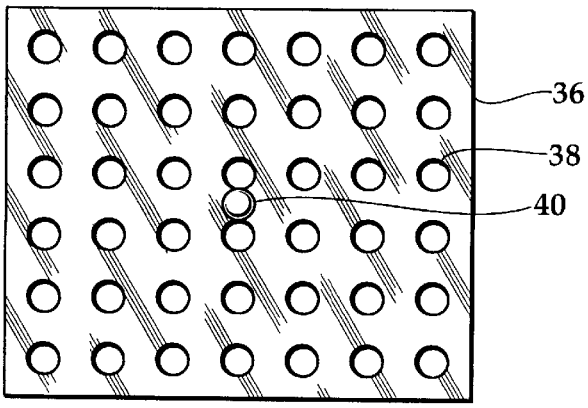
FIG. 5 is a top plan view of an evaporator lid (36) of FIG. 1.

The invention further includes a liquid containing basin 42 also having transparent upright side walls and a sealed bottom panel for containing a quantity of aromatic, vaporizable liquid such as a liqueur or other liquor or alcohol based liquid. A cigar suspension or support rack shown generally at numeral 20 is further provided as part of the invention 10. As best seen in FIGS. 3 and 4, the cigar suspension rack 20 includes two spaced apart cigar support panels 26 each having identically positioned and spaced apertures 28 formed therethrough. These cigar support panels 26 are held in alignment vertically and spaced apart by elongated transparent acrylic posts shown typically at 24 disposed at each corner of the rectangular-shaped cigar support panels 26.

As part of the rack 20, disposed at a lower end portion of each of the posts 24 is a transparent diffusion tray 22 having an open upper margin 34 and a solid bottom panel 32. This diffusion tray 22 is positioned below the lower of the two cigar support panels 26 so that each cigar shown in phantom at C in FIG. 1 is laterally supported within aligned apertures typically at 28 of each of the cigar support panels 26, with the lower end of each of the cigars C then resting atop the upper surface of bottom panel 32. By this arrangement, the cigars C are held in spaced apart upright orientation within any of the available aligned apertures 28.

An evaporator panel 36 is also provided having an array of spaced apertures shown typically at 38 and a spherical handle 40. Again, the preferred material for fabricating this evaporator panel, as with all of the components of the preferred embodiment of the device 10, is transparent acrylic material in the range of 3/16" thickness when flat stock is required.

Figure 6:
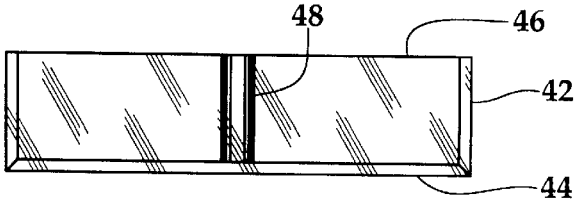
FIG. 6 is a side elevation view of a liquid basin (42) of FIG. 1.

The evaporator panel 36 is sized to rest atop the open upper margin 46 of the liquid basin 42 and a centrally positioned support post and handle 48 best seen in FIG. 6. The cigar suspension rack 20 rests directly atop this evaporator panel 36 on spherical legs 30 connected to the lower panel 32 of diffusion tray 22 as best seen in FIG. 1.

By this arrangement, with lid 14 removed, the liquid tray 42, filled with a quantity of aromatic vaporizable or evaporated liquid L such as a flavored liqueur, is first placed into the enclosure 12 atop the bottom panel 58. Post or handle 48 provides a place to hand grasp the liquid tray 42 during this positioning. Thereafter, the separate evaporator panel 36 is placed directly atop the upper open margin 46 of the liquid tray 42. The cigar suspension rack 20 is then placed into the enclosure 12 atop the evaporator panel 36, after which any desired number of cigars C are placed through aligned apertures 28 of the upper and lower cigar support panels 26.

The vapors from the aromatic liquid L first pass upwardly through apertures 42 of the evaporator panel 36 in the direction of arrows A in FIG. 1. Because the bottom panel 32 of diffusion tray 22 is preferably solid and aperture free, the vapors then move outwardly as shown by arrows A to pass upwardly between a gap 50 defined between the inner side wall surfaces of the enclosure 12 and the side surfaces of diffusion tray 22. Vapors thus pass upwardly into the central portion of the enclosure 12 in the direction of arrows B. By this arrangement of vapor redirection through gap 50, a more uniform distribution of aromatic vapors is provided to surround and permeate each of the cigars C within the device 10. By the selection of the size and number of apertures 38 within the evaporator panel 36, the rate of evaporation of the aromatic liquid L is controlled, thus directly impacting upon the level of aromatic flavoring of the cigars C within the device 10.

Transparent acrylic legs 18 disposed to the bottom panel 58 as seen in FIG. 1 are also provided for decoration and spacing of the device 10 above a support surface. A transparent card holder 52 may also be provided attached to the outer surface of one of the side walls of enclosure 12 to receive a card having a written description of the particular aromatic liquid L contained within the liquid tray 42.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A cigar aromatizing device comprising:

an enclosure having a bottom surface and a removable lid for covering an opening of said enclosure;

a liquid tray positionable through said opening into said enclosure adjacent said bottom surface, said liquid tray having an open upper end thereof and a sealed bottom for holding and facilitating evaporation of a quantity of vaporizable aromatic liquid therein;

a cigar suspension rack positionable through said opening into said enclosure above said liquid tray, said rack configured to removably support a plurality of cigars each in spaced apart relation one cigar to another wherein each of said cigars may be supportively inserted into, and removed from, said rack and whereby, when the aromatic liquid is placed in said liquid tray and allowed to vaporize at substantially ambient conditions within said enclosure with said lid covering said opening, each cigar in said rack becomes aromatically flavored by vapors produced from the aromatic liquid.

2. A cigar aromatizing device comprising:

enclosure means having an openable lid for defining a substantially sealed interior volume;

liquid tray means positionable within said interior volume for holding a quantity of vaporizable aromatic liquid, said liquid tray means having an open upper portion and a sealed bottom for holding and allowing the aromatic liquid to evaporate into said interior volume;

cigar support means positionable in said enclosure above said liquid tray means for removably supporting a plurality of cigars each in spaced apart relation one to another within said enclosure whereby vapors from the aromatic liquid flavor each cigar in said enclosure.

3. A cigar aromatizing device comprising:

an enclosure having an open upper end, a bottom surface, and a lid for covering and substantially sealing said enclosure open upper end;

a liquid tray positionable within said enclosure above said bottom surface, said liquid tray open at an upper end thereof;

an evaporator lid positionable within said enclosure atop said liquid tray open upper end and having an array of spaced vapor apertures formed therethrough;

a cigar suspension rack positionable in spaced relation above said evaporator lid, said rack including a lower diffusion panel and spaced apart upper and lower cigar support panels, each said cigar support panel having an array of spaced cigar support apertures formed therethrough which are substantially aligned between said upper and said lower cigar support panels whereby cigars are individually supported in generally upright spaced relation within aligned said cigar apertures, a lower end of each cigar in said rack being supported from vertical movement atop said diffusion panel;

said liquid tray being capable of holding a quantity of vaporizable aromatic liquor which emits aromatic vapors upwardly through said vapor apertures whereby the cigars held in said rack are permeated and flavored with the aromatic vapors.

4. A cigar aromatizing device as set forth in claim 3, wherein:

said diffusion panel is substantially aperture-free and sized to define a vapor gap with respect to each side wall of said enclosure whereby the aromatic vapors form said liquid tray are directed outwardly and then upwardly substantially only through said vapor gap for enhanced aromatic vapor circulation around each cigar.

5. A cigar aromatizing device as set forth in claim 4, further comprising:

an evaporator panel or lid having spaced evaporation apertures formed therethrough, said evaporator panel sized to be positioned over said liquid tray upper end whereby the rate of evaporation of the liqueur is regulated based upon the number and size of said evaporation apertures.

* * * * *